US005928013A

United States Patent [19]

Iwahori

[11] Patent Number: 5,928,013

[45] Date of Patent: Jul. 27, 1999

[54] COMPACT SIZED CONNECTOR FOR CONNECTING MALE AND FEMALE HOUSINGS WITH A CAM DEVICE

[75] Inventor: Yoshihiro Iwahori, Shizuoka, Japan

[73] Assignee: Yazaki Corporation, Tokyo, Japan

[21] Appl. No.: 08/998,759

[22] Filed: Dec. 29, 1997

[30] Foreign Application Priority Data

Dec. 25, 1996 [JP] Japan ..... 8-345814

[51] Int. Cl.[6] ..... H01R 13/629

[52] U.S. Cl. ..... 439/157; 439/347

[58] Field of Search ..... 439/157, 152, 439/153, 347, 344, 270, 953

[56] References Cited

U.S. PATENT DOCUMENTS

| | | | |
|---|---|---|---|
| 4,332,432 | 6/1982 | Colleran | 439/347 |
| 5,478,251 | 12/1995 | Jaklin | 439/341 |
| 5,575,676 | 11/1996 | Tsukakoshi et al. | 439/347 |

FOREIGN PATENT DOCUMENTS

| | | | |
|---|---|---|---|
| 36 45 179 | 4/1986 | Germany | 439/157 |
| 61-203581 | 9/1986 | Japan | H01R 13/629 |

OTHER PUBLICATIONS

EP 0 801 441 A1, Yoshihiro Iwahori, "Low Insertion Pressure Connector", Mar. 17, 1997.

EP 0 865 112 A2, Yoshihiro Iwahori, "Low Insertion Force Connector Assembly", Mar. 12, 1998.

*Primary Examiner*—Neil Abrams

*Assistant Examiner*—Michael C. Zarroli

*Attorney, Agent, or Firm*—Sughrue, Mion, Zinn Macpeak & Seas, PLLC

[57] ABSTRACT

A low insertion force connector which is compact and which is designed so that the cam slider does not protrude from the connector housings when the two connectors are completely engaged with each other. The low insertion force connector includes a first housing, a second housing having a hood, and a slide member. The first housing has first and second cam projection portions which are mounted, respectively, on opposed walls of a housing body. The slide member has a pair of wings extending substantially perpendicularly, each from opposite ends of a flat plate-like base portion. The pair of wings have a first cam groove, for slidably guiding the first cam projection portion, formed on an inner surface of one of the two wings, extending from a side edge of the one wing, and second cam groove, for slidably guiding the second cam projection portion, is formed in an inner surface of the other wing. After the two housings are fitted together, the pair of wings are received in the hood. The two cam projection portions are contractible, and are disposed axially. If the pair of wings are superimposed on each other, a rear end of the first cam groove overlaps a front end of the second cam groove. Thus, when one of the two cam projection portions is slidingly moved, the other cam projection is pushed inward, or retracted into the first housing.

11 Claims, 10 Drawing Sheets

COMPACT SIZED CONNECTOR FOR CONNECTING MALE AND FEMALE HOUSINGS WITH A CAM DEVICE

BACKGROUND OF THE INVENTION

1. Field of the Invention

This invention relates to a low insertion force connector in which two connector housings are fitted together through a cam mechanism by a slide member.

2. Related art

There has been proposed a connector assembly (Japanese Patent Unexamined Publication No. 61-203581) in which one of a pair of connector housings is fitted relative to the other connector housing through a cam mechanism with a low insertion force by inserting a slide member into the one connector housing.

In FIG. 15, this connector assembly 70 comprises the one connector housing 71, the other connector housing 72 and a cam follower member 73, and the other connector housing 72 is inserted into the one connector housing 71 as shown in FIG. 16. When the cam follower member 73 is moved right, each of followers 74 of the cam follower member 73 moves in a corresponding slot 75 in the one connector housing 71 and a corresponding cam track 76 in the other connector housing 72, so that the one connector housing 71 and the other connector housing 72 are fitted together as shown in FIG. 17.

However, before and after the one connector housing 71 and the other connector housing 72 are fitted together by the cam follower member 73, the cam follower member 73 projects from the other connector housing 72 (see FIGS. 16 and 17). Therefore, there has been encountered a disadvantage that the connector assembly 70 has an increased size.

SUMMARY OF THE INVENTION

It is an object of this invention to provide a low insertion force connector in which the connector, assembled by fitting one connector housing and the other connector housing together through a cam mechanism by a slide member, does not have an increased size.

The above object of the invention has been achieved by a low insertion force connector comprising a first housing, a second housing having a hood for receiving the first housing, and a slide member for insertion into the hood, wherein the first and second housings are fitted together through a cam mechanism by moving the slide member. According to the invention, the first housing has a first cam projection portion and a second cam projection portion mounted respectively on opposed walls of a housing body; the slide member has a pair of wings extending substantially perpendicularly respectively on opposed walls of a housing body; the slide member has a pair of wings extending substantially perpendicularly respectively from opposite ends of a flat plate-like base portion in the same direction, and a first cam groove for slidably guiding the first cam projection portion is formed in an inner surface of one of the two wings, and extends from a side edge of the one wing, and a second cam groove for slidably guiding the second cam projection portion is formed in an inner surface of the other of the two wings; and after the first and second housings are fitted together, the pair of wings are received in the hood.

In the low insertion force connector, the first and second cam projection portions are retractable, and are disposed on a common straight line, and if the pair of wings are superimposed on each other, a rear end of the first cam groove overlaps a front end of the second cam groove, and when one of the first and second cam projection portions is slidingly moved, the other cam projection is contracted (i.e., retracted into the housing).

According to a further aspect of the invention, the first and second cam projection portions, formed on the housing body of the first housing, are opposed to each other, and the first and second cam grooves are formed respectively in the inner surfaces of the pair of wings of the slide member. The first cam projection portion slides along the first cam groove, and the second cam projection portion slides along the second cam groove. After the first housing and the second housing are fitted together, the pair of wings are received in the hood. Therefore, the pair of wings do not project from the hood after the fitting of the connectors.

Further, the first and second cam projection portions, provided on the housing body of the first housing, are contractible. Therefore, even if an external force acts on the first or the second cam projection portions, the cam projection portion retreats inwardly to absorb the external force, so that the first and second cam projections will not be affected by the external force. If the pair of wings are superimposed on each other, the rear end of the first cam groove overlaps the front end of the second cam groove, and the rear end of the first cam groove and the front end of the second cam groove are disposed on a straight line. Therefore, when the first cam projection portion slides along the first cam groove, the second cam projection is retracted, and when the second cam projection portion slides along the second cam groove, the first cam projection portion is retracted.

DETAILED DESCRIPTION OF THE INVENTION

A preferred embodiment of the present invention will now be described with reference to the drawings. In this embodiment, one connector housing is a male connector housing (hereinafter referred to as "male housing"), and the other connector housing is a female connector housing (hereinafter referred to as "female housing"), but the invention is not limited to such an arrangement.

FIGS. 1 to 13 show one preferred embodiment of a low insertion force connector of the present invention.

Figure 1:
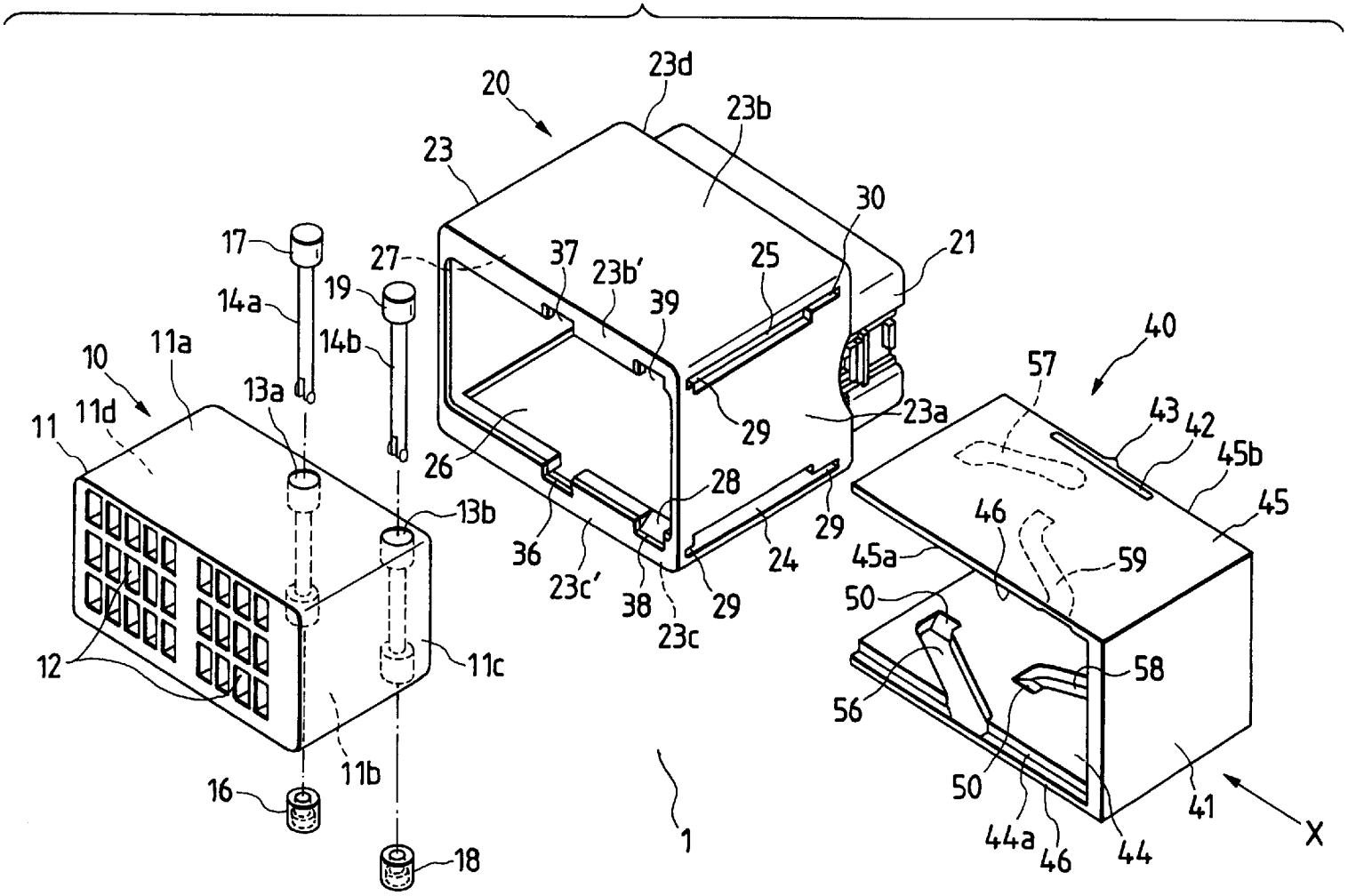
FIG. 1 is an exploded, perspective view showing a preferred embodiment of a low insertion force connector of the present invention.

In FIG. 1, this low insertion force connector 1 comprises a male housing 10, a female housing 20 for receiving the male housing 10, and a slide member 40 for urging the male housing 10 into the female housing 20 through a cam mechanism.

The male housing 10 includes a housing body 11 having a plurality of terminal receiving chambers 12, a first through hole 13*a* extending straight through the housing body 11 between outer surfaces of its upper wall 11*a* and lower wall 11*b*, and a second through hole 13*b* which extends through the housing body 11 in parallel relation to the first through hole 13*a*, and is spaced a predetermined distance from the first through hole 13*a*, and a pair of first and second shafts 14*a* and 14*b* inserted respectively in the first and second through holes 13*a* and 13*b*.

Each of the through holes 13*a* and 13*b* extend in a direction that is perpendicular to the direction in which the terminal receiving chambers 12 extend. A first cam pin (first cam projection portion) 16 and a second cam pin (second cam projection portion) 17 are fixedly mounted respectively on opposite ends of the first shaft 14*a*, and similarly a first parallel cam pin 18 and a second parallel cam pin 19 are fixedly mounted respectively on the second shaft 14*b*. The cam pins 16, 17, 18 and 19 are contractible (i.e., contractible toward the housing body 11). Each of the cam pins 16, 17, 18 and 19 is normally urged outwardly from the housing body 11. The first through hole 13*a* and the second through hole 13*b* may extend through the housing body 11 between outer surfaces of its right and left walls 11*c* and 11*d*. Alternatively, only the first through hole 13*a* may be formed through the housing body 11.

The cam pins 16, 17, 18 and 19 are thus contractible. Therefore, even if an external force acts on the male housing 10 during transport of the male and female housings 10 and 20 before the two housings are fitted together, each cam pin 16, 17, 18, 19 is moved inward to absorb the external force, and therefore will not be damaged. Therefore, the operator can transport the male housing 10 without anxiety over concern that the housing may be damaged.

The female housing 20 comprises a housing body 21 having a plurality of terminal receiving chambers 22, and a hood 23 formed on an outer peripheral surface of the housing body 21 so as to receive the male housing 11 therein.

A pair of insertion holes 24 and 25 for receiving slide member 40 into the hood 23 are formed through a right wall 23*a* of the hood 23, and a pair of support portions 26 and 27 for respectively supporting wings 44 and 45 of the slide member 40 are formed respectively on opposed surfaces of lower and upper walls 23*c* and 23*b* of the hood 23. A first pin introduction portion 36 for guiding the first cam pin 16 to the lower support portion 26, as well as a first parallel pin introduction portion 38 for guiding the first parallel cam pin 18 to the lower wing 44, is formed at a front end 23*c*' of the lower wall 23*c* of the hood 23. Correspondingly, a second pin introduction portion 37 for guiding the second cam pin 17 to the upper wing 45, as well as a second parallel pin introduction portion 39 for guiding the second parallel cam pin 19 to the upper support portion 27, is formed at a front end 23*b*' of the upper wall 23*b* of the hood 23.

An inclined surface 28, inclined into the hood 23, is formed on each of the first parallel pin introduction portion 38 and the second pin introduction portion 37. The wings 44 and 45 of the slide member 40, passing respectively through the insertion holes 24 and 25, are supported on the support portions 26 and 27 in the hood 23.

The slide member 40 includes a base portion 41 in the form of a flat plate, and the pair of wings 44 and 45 extending respectively from opposite ends of the base portion 41 in the same direction. A first cam groove 56 for slidably guiding the first cam pin 16 and a first parallel cam groove 58 for slidably guiding the first parallel pin 18 are formed in that side of the lower wing 44 facing the upper wing 45. Correspondingly, a second cam groove 57 for slidably guiding the second cam pin 17 and a second parallel cam groove 59 for slidably guiding the second parallel cam pin 19 are formed in that side of the upper wing 45 facing the lower wing 44. A slit-like slot 42 is formed through the upper wing 45 along its right side edge 45*b*, and a retaining projection 43 is formed at that portion of the upper wing 45 corresponding to a central portion of the slot 42.

The slot 42 (FIG. 7) is provided in the vicinity of the retaining projection 43. Therefore, the retaining projection 43 can be resiliently displaced in a direction generally perpendicular to the right and left side edges of the upper wing 45. Guide rails 46 (FIG. 3) are formed respectively at a right side edge (not shown) and a left side edge 44*a* of the lower wing 44 and the left side edge 45*a* of the upper wing 45. A rail hole 29 and a projection hole 30, corresponding respectively to the guide rail 46 and the retaining projection 43, are formed at opposite ends of the insertion hole 25 in the hood 23. Additionally, rail holes 29, corresponding respectively to the guide rails 46, are formed at opposite ends of the insertion hole 24 in the hood 23. A pair of first and second engagement holes 31*a* and 31*b* (FIG. 7) for engagement with the retaining projection 43 are formed in a rear wall 23*d* of the hood 23.

Figure 2:
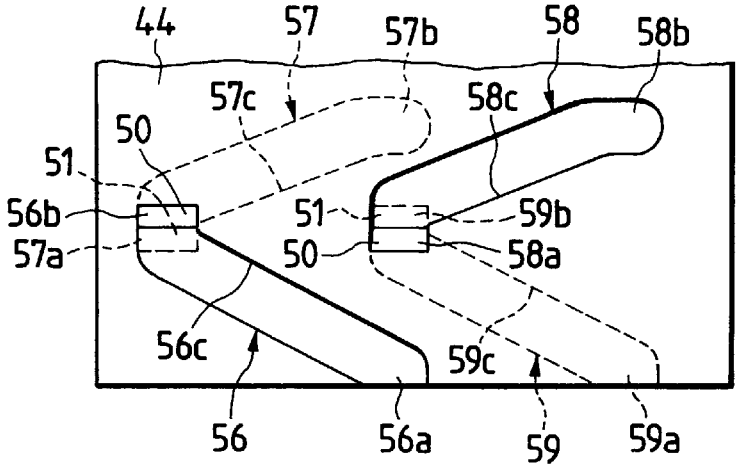
FIG. 2 is a top plan view showing a pair of wings superimposed on each other.

If the pair of wings 44 and 45 are superimposed on each other as shown in FIG. 2 (which shows the wings 44 and 45 in an orthogonal projection), a rear end 56b of the first cam groove 56 overlaps a front end 57*a* of the second cam groove 57, and also a rear end 59*b* of the second parallel cam groove 59 overlaps a front end 58*a* of the first parallel cam groove 58, and in this condition each mating pair of cam grooves assumes a V-shape. A slanting surface 50, directed toward the upper wing 45, is formed at each of the rear end 56*b* of the first cam groove 56 and the front end 58*a* of the first parallel cam groove 58, and a slanting surface 51, directed toward the lower wing 44, is formed at the front end 57*a* of the second cam groove 57 and the rear end 59*b* of the second parallel cam groove 59.

Figure 3:
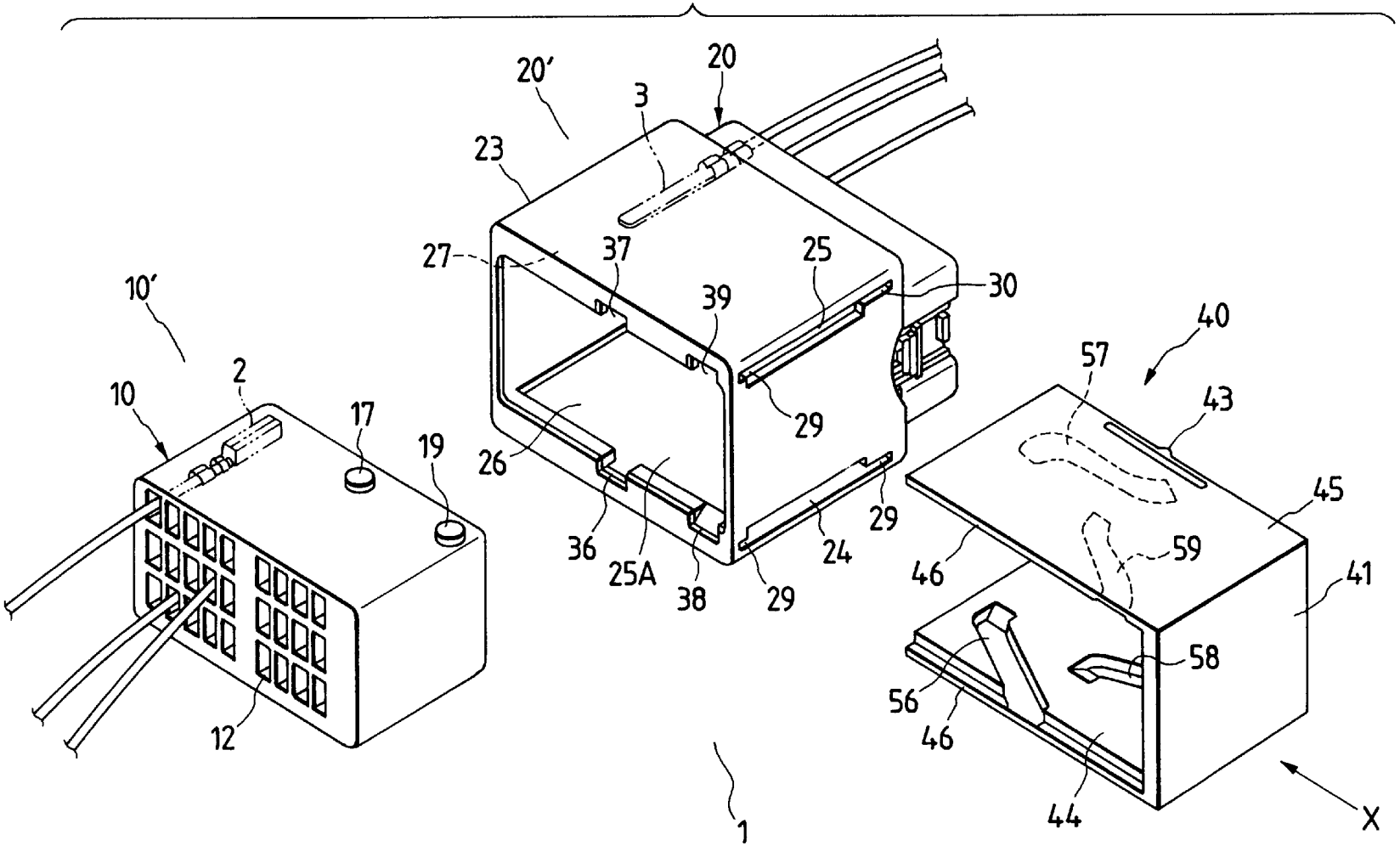
FIG. 3 is a perspective view showing a condition prior to the male connector and the female connector being fitted together.
Figure 5:
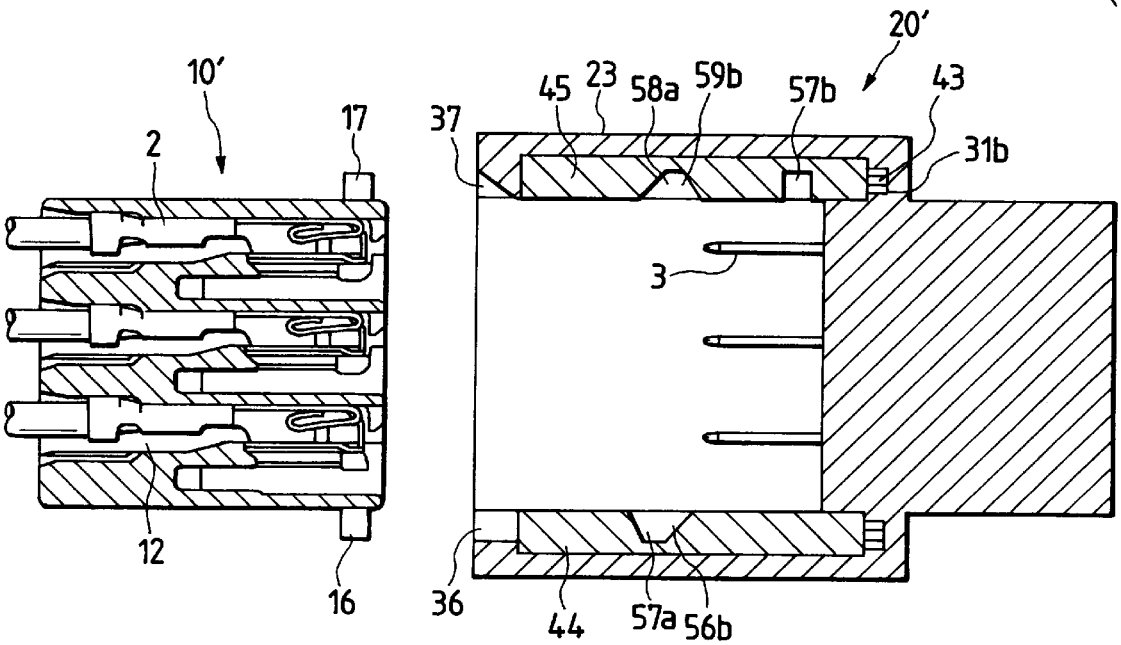
FIG. 5 is a cross-sectional view taken along the line 5—5 of FIG. 4.
Figure 6:
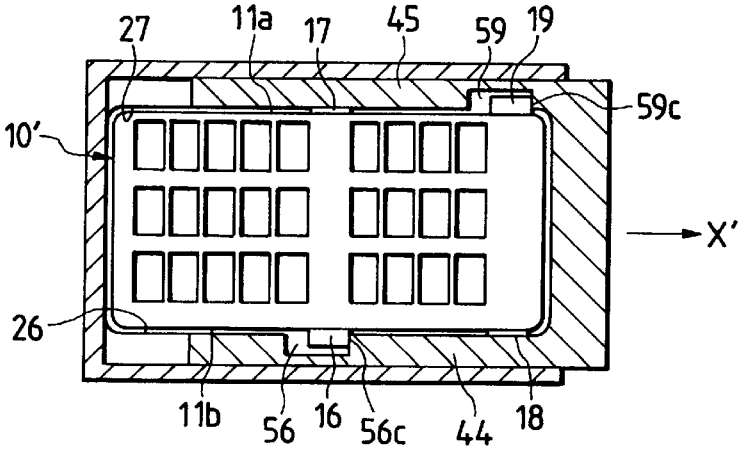
FIG. 6 is a view showing a condition in which the male connector is initially inserted into the female connector into which the slide member has been inserted.
Figure 7:
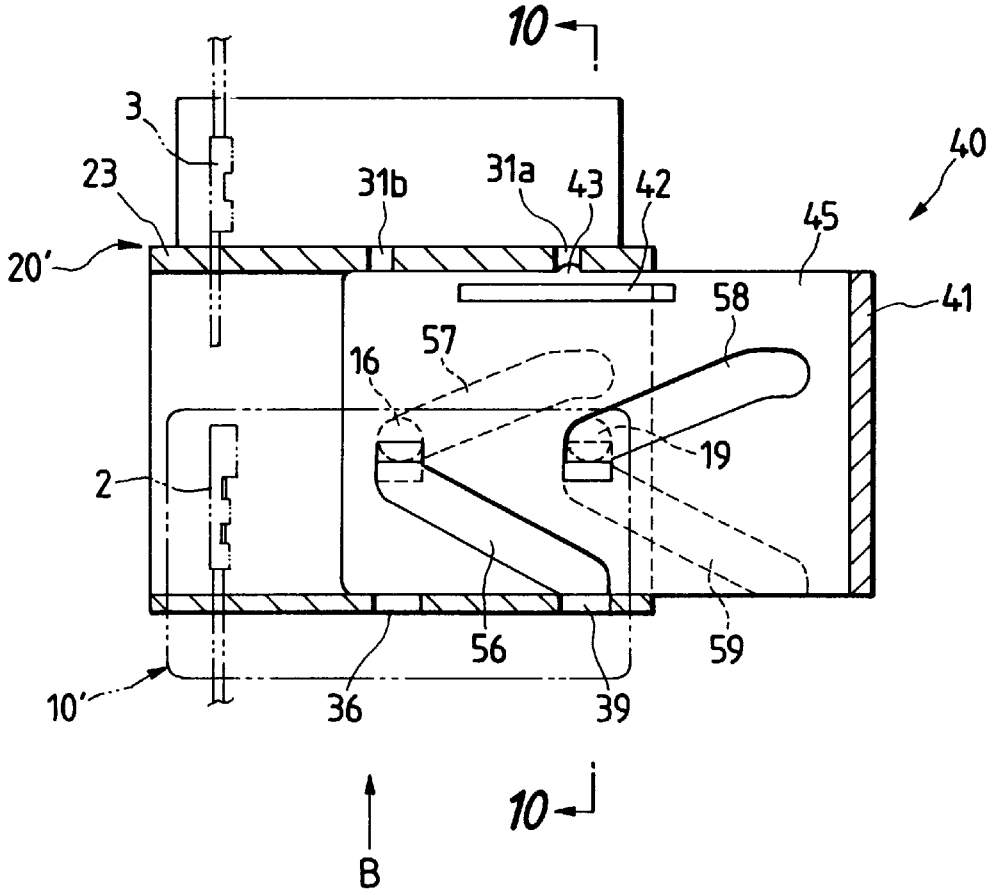
FIG. 7 is a view showing a condition during the fitting of the male and female connectors relative to each other.
Figure 8:
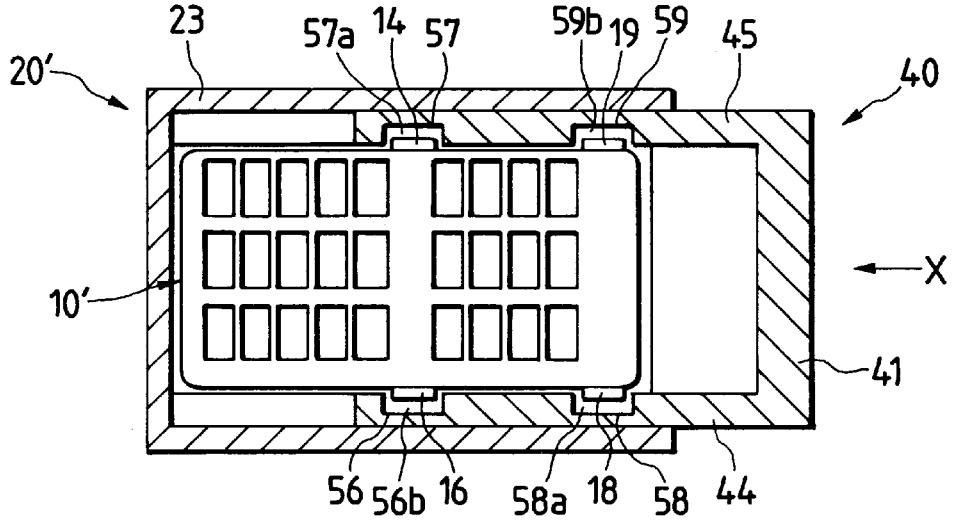
FIG. 8 is a view as seen in the direction of arrow B of FIG. 7.
Figure 9:
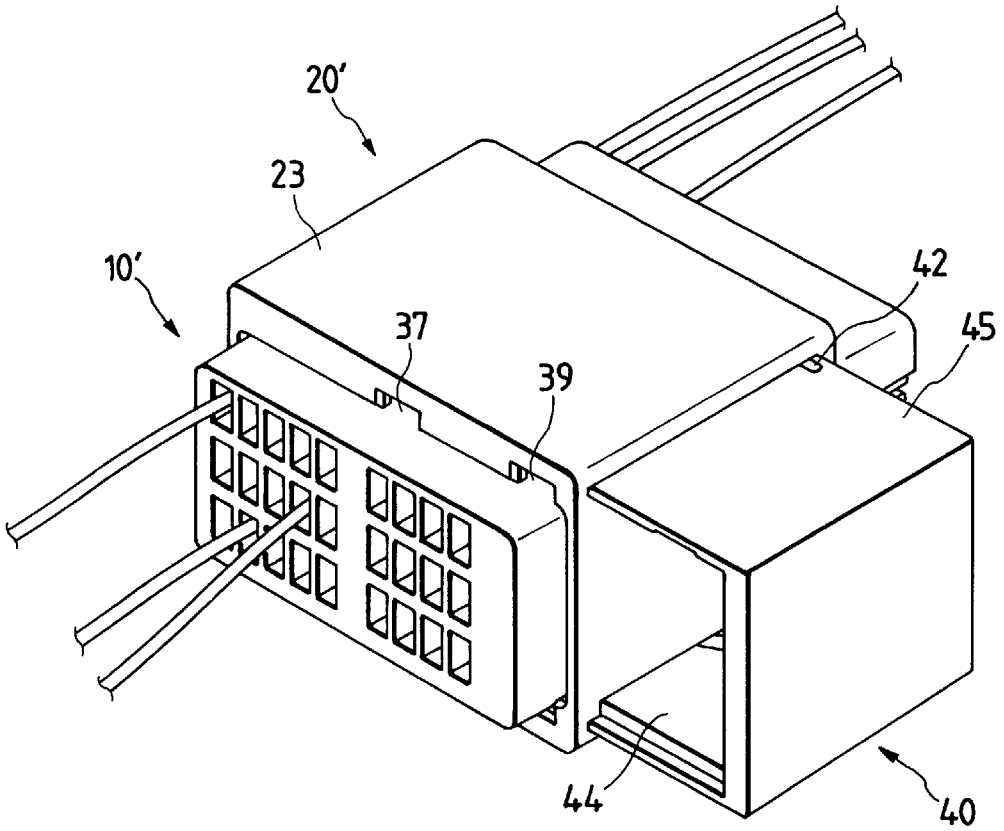
FIG. 9 is a perspective view showing the fitting operation of the connectors.
Figure 10:
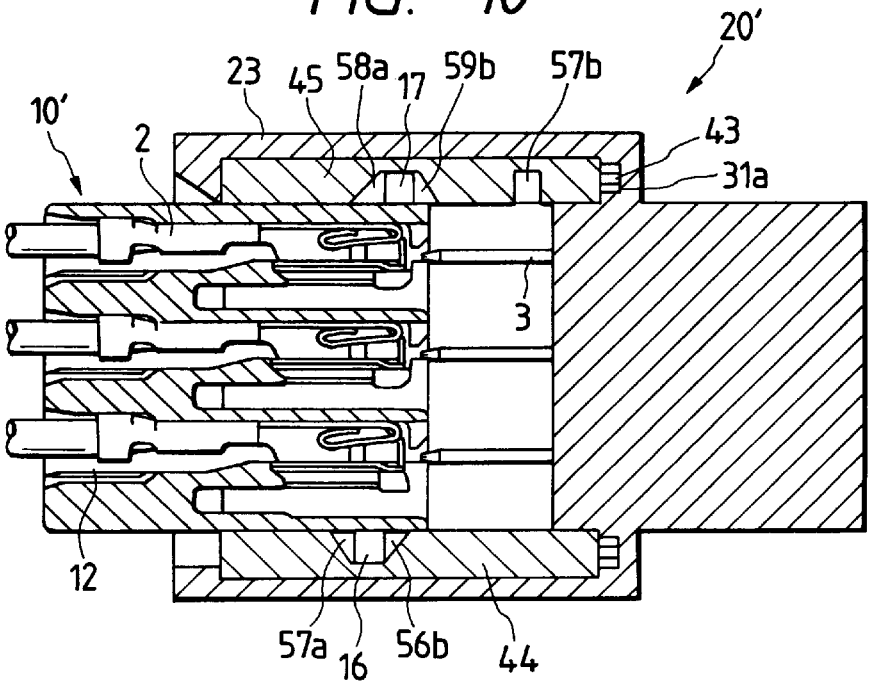
FIG. 10 is a cross-sectional view taken along the line 10—10 of FIG. 7.

Next, with reference to FIG. 3, explanation will be made of an operation in which the male connector 10', having female terminals 29 (each connected to a wire) retainingly received in the male housing 10, is fitted into the female connector 20' having male terminals 3 (each connected to a wire) retainingly received in the female connector housing 20.

Figure 4:
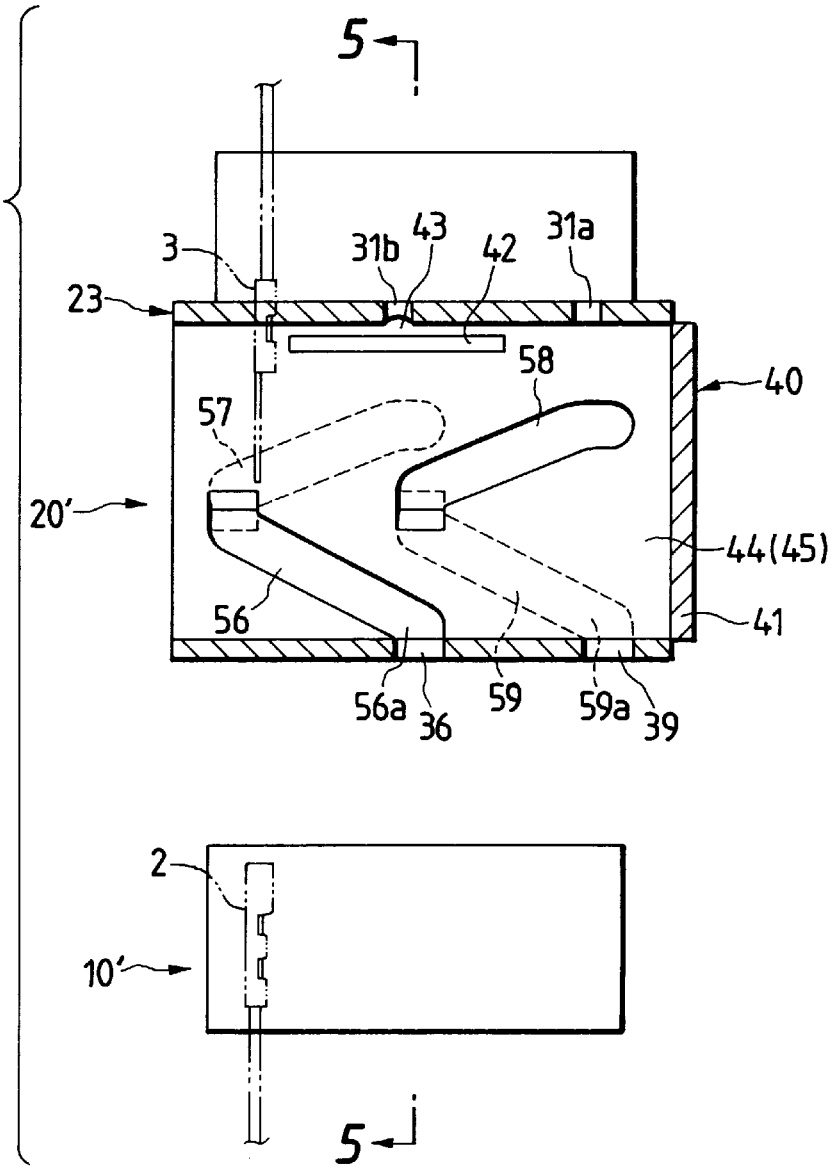
FIG. 4 is a view showing a condition in which a slide member is inserted into the female connector.

First, the base portion 41 is pushed in the direction of arrow X so as to pass the wings 44 and 45 respectively through the insertion holes 24 and 25, with the guide rails 46 of the wings 44 and 45 engaged in the respective rail holes 29. The retaining projection 43 is passed through the projection hole 30, and is resiliently displaced, and is engaged in the first engagement hole 31*a*. When the base portion 41 is further pushed, the retaining projection 43 is disengaged from the first engagement hole 31*a* as shown in FIG. 4. Then, when the retaining projection 43 is engaged in the second engagement hole 31*b*, the wings 44 and 45 are placed on the support portions 26 and 27, respectively. An inlet portion 56*a* of the first cam groove 56 is aligned with the first pin introduction portion 36, and also an inlet portion 59*a* of the second parallel cam groove 59 is aligned with the second parallel pin introduction portion 39.

Secondly, when the male connector 10' is inserted into the hood 23 (see FIG. 5), the first cam pin 16 advances into the first cam groove 56 through the first pin introduction portion 36 and the inlet portion 56*a* of the first cam groove 56. As shown in FIGS. 5 to 10, the second cam pin 17 advances along the inclined surface 28 at the second pin introduction portion 37, and the second cam pin 17 is gradually contracted by the inclined surface 28. When the second cam pin 17 passes past the second pin introduction portion 37, the second cam pin 17, while kept contracted, is positioned between the upper wing 45 and the housing body 11. Similar to the second cam pin 17, the first parallel cam pin 18, while kept contracted, is positioned between the lower wing 44 and the housing body 11. Similar to the first cam pin 16, the second parallel cam pin 19 advances into the second parallel cam groove 59 through the second parallel pin introduction portion 39 and the inlet portion 59*a* of the second parallel cam groove 59.

Thirdly, when the male connector 10' is further pushed into the hood 23, the first cam pin 16 and the second parallel cam pin 19 slidingly move along the first cam groove 56 and the second parallel cam groove 59, respectively, and the first cam pin 16 presses a groove surface 56*c* of the first cam groove 56, and also the second parallel cam pin 19 presses a groove surface 59*c* of the second parallel cam groove 59. As a result, the retaining projection 43 is disengaged from the second engagement hole 31*b*, and the slide member 40 is pushed out in a direction X' until the retaining projection 43 is engaged in the first engagement hole 31*a*.

The retaining projection 43 is engaged in the first engagement hole 31*a*, and also the front end 57*a* of the second cam groove 57 is disposed above the rear end 56*b* of the first cam groove 56, and the front end 58*a* of the first parallel cam groove 58 is disposed below the rear end 59*b* of the second parallel cam groove 59. Even in this condition, since the male connector 10' is pushed into the hood 23, the first cam pin 16 advances along the inclined surface 50 of the rear end 56*b* of the first cam groove 56, and is contracted, and the second cam pin 17 advances along the slanting surface 51 of the front end 57*a* of the second cam groove 57, and is expanded. Additionally, the second parallel cam pin 19 advances along the slanting surface 51 of the rear end 59*b* of the second parallel cam groove 59, and is contracted, and the first parallel cam pin 18 advances along the slanting surface 50 of the first parallel cam groove 58, and is expanded.

Namely, the first cam pin 16, while kept contracted, is disposed between the housing body 11 and the lower wing 45, and the second cam pin 17, while kept expanded, enters the front end 57*a* of the second cam groove 57. Similarly, the second parallel pin 19, while kept contracted, is disposed between the housing body 11 and the upper wing 45, and the first parallel cam pin 18, while kept expanded, enters the front end 58*a* of the first parallel cam groove 58.

Figure 11:
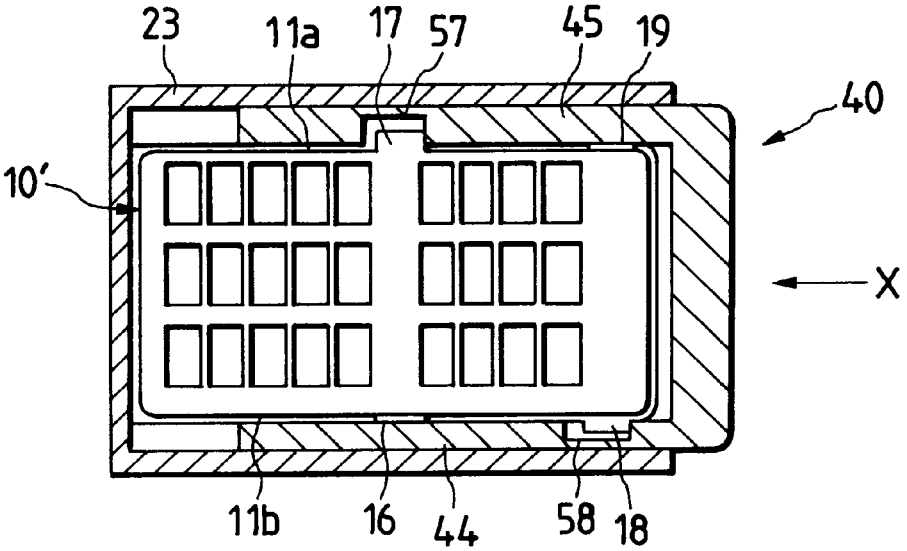
FIG. 11 is a view showing a condition in which the slide member is pushed in a direction X.
Figure 12:
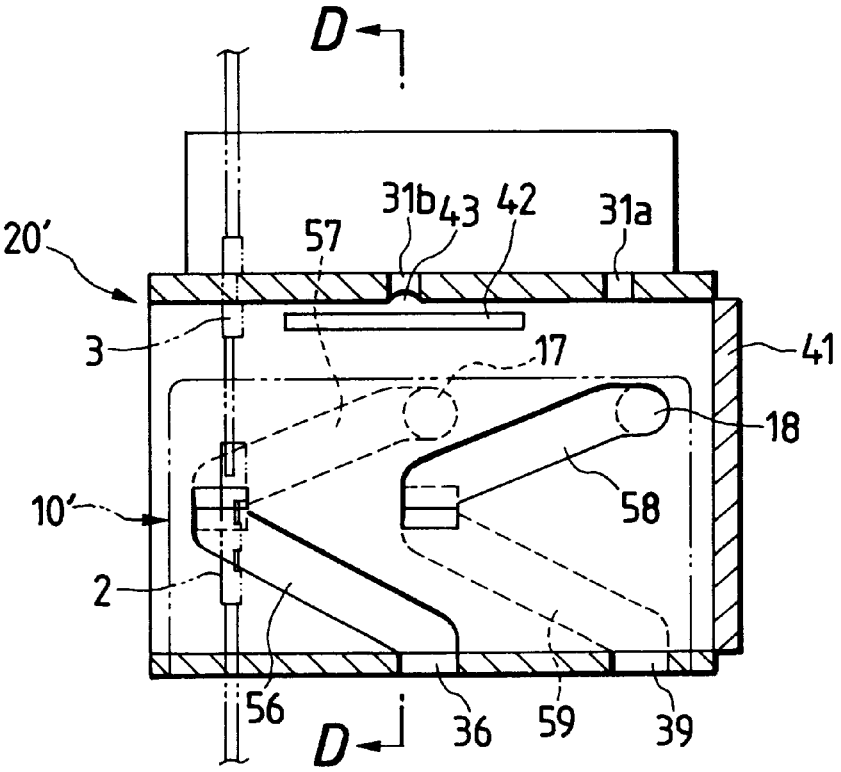
FIG. 12 is a view showing a condition after the male and female connectors are fitted together.
Figure 13:
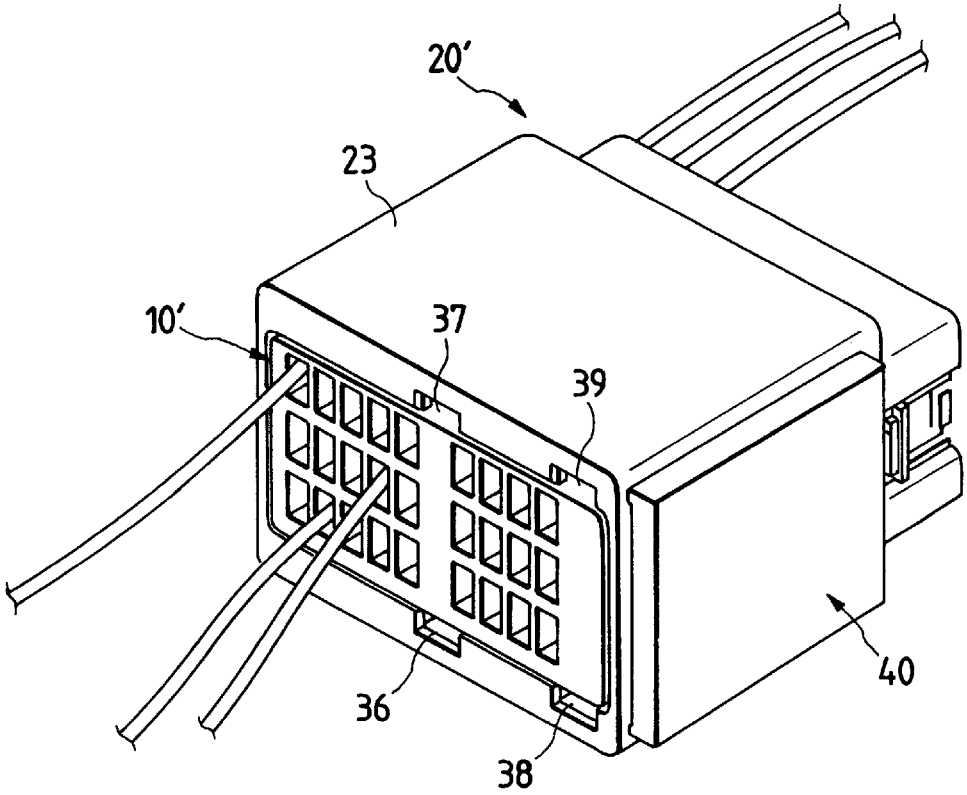
FIG. 13 is a perspective view showing the overall construction of the connector after the fitting operation.
Figure 14:
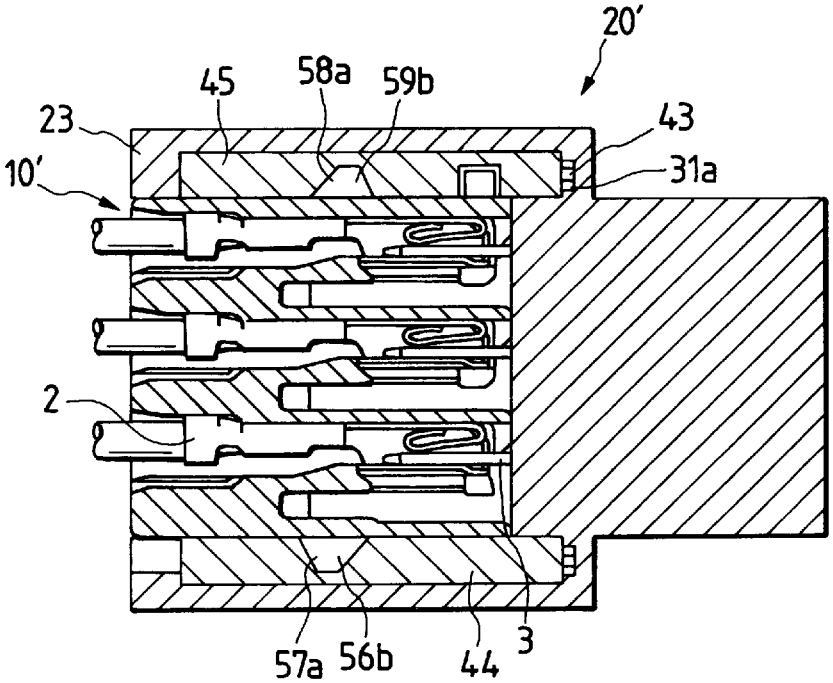
FIG. 14 is a cross-sectional view taken along the line 14—14 of FIG. 12.
Figure 15:
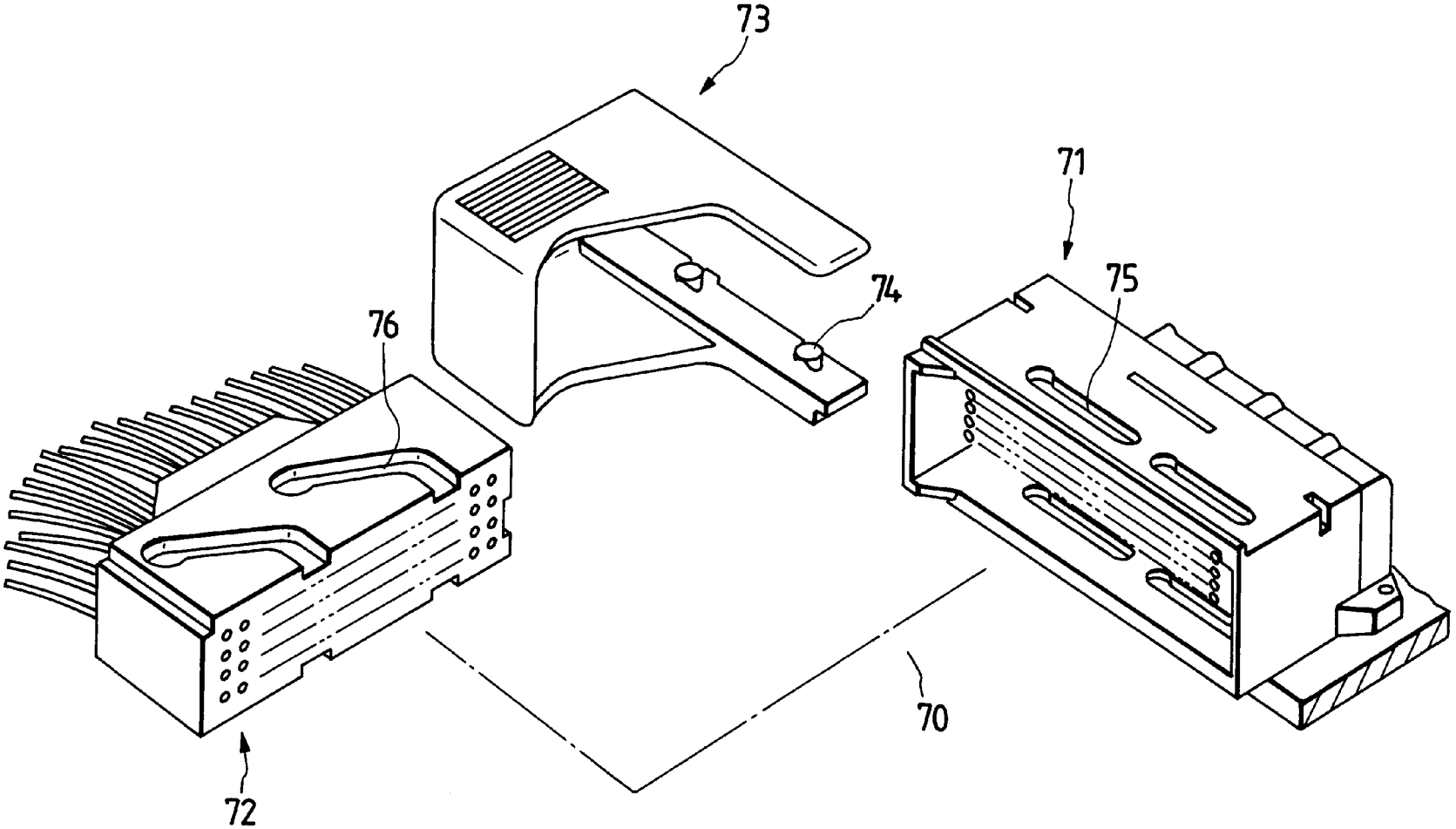
FIG. 15 is an exploded, perspective view showing a conventional connector assembly.
Figure 16:
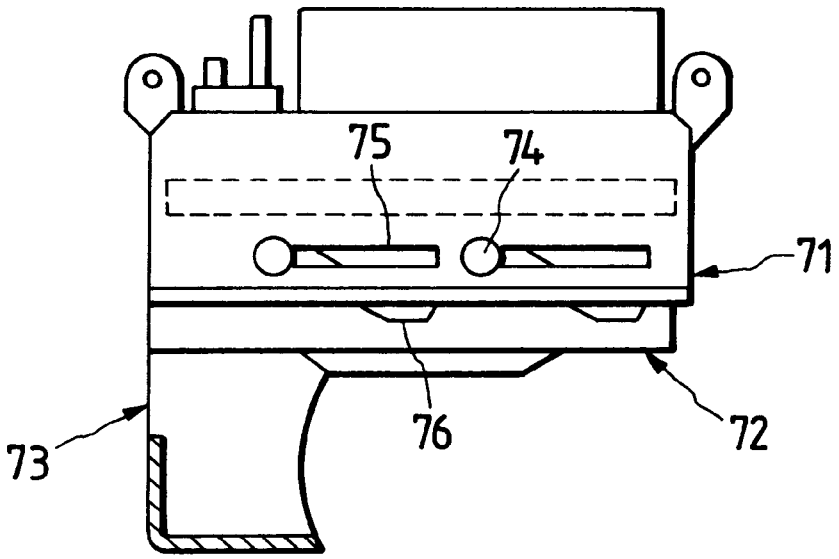
FIG. 16 is a view showing a condition before the connector housings of the connector assembly of FIG. 15 are fitted together.
Figure 17:
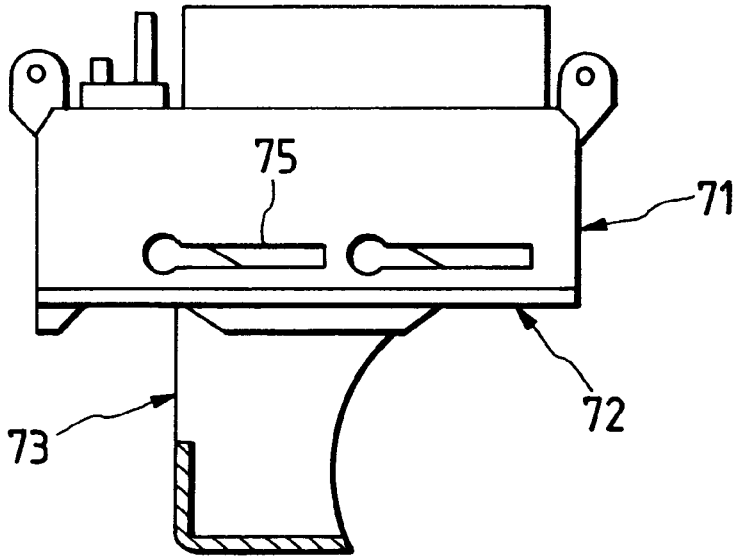
FIG. 17 is a view showing a condition after the connector housings of the connector assembly of FIG. 16 are fitted together.

Finally, when the slide member 40 is pushed in the direction of arrow X in FIG. 11, the retaining projection 43 is disengaged from the first engagement hole 31*a* as shown in FIGS. 12 to 14, and the slide member 40 is inserted into the hood 23. When the slide member 40 advances, a groove surface 57*c* of the second cam grove 57 presses the second cam pin 17, and also a groove surface 58*c* of the first parallel cam groove 58 presses the first parallel cam pin 18. As a result the male connector 10' is gradually pulled into the hood 23.

The male connector 10' is inserted into the hood 23 until the retaining projection 43 is engaged in the second engagement hole 31*b*. After this engagement is effected, the second cam pin 17 reaches the rear end 57*b* of the second cam groove 57, and also the first parallel cam pin 18 reaches the rear end 58*b* of the first parallel cam groove 58. Thus, the male connector 10' and the female connector 20' are automatically fitted together and the female terminals 2 in the male connector 10' are electrically connected respectively to the male terminals 3 in the female connector 20'.

Therefore, after the male connector 10' and the female connector 20' are fitted together, the slide member 40 is completely inserted into and retained on the hood 23 of the female connector 20'. As a result, the connector 1, assembled by fitting the two connector housings together, has a smaller size as compared with the conventional connector.

Thus, according to the invention, the first cam projection portion and the second cam projection portion are provided on the housing body of the first housing in opposed relation to each other, and the pair of first and second cam grooves formed respectively in the pair of wings of the slide member, and after the first and second housings are fitted together, the slide member is inserted into the hood, and therefore the pair of winds will not project from the hood. With this construction, the connector, obtained after the two housings are fitted together, can have a smaller size as compared with the conventional construction. Therefore, the connector, obtained after the fitting of the connector housings, can be mounted in a wider variety of spaces as compared with the conventional construction.

I claim:

1. A low insertion force connector, comprising:

a first housing including a housing body and a first cam projection portion and a second cam projection portion mounted respectively on opposed walls of said housing body, said first and second cam projection portions being retractable into said housing body;

a second housing having a hood for receiving said first housing;

a slide member insertable into said hood, said slide member including a base portion and a pair of wings extending substantially perpendicularly respectively from opposite ends of said base portion in the same direction, a first wing of said pair of wings having a first cam groove formed in an inner surface thereof and extending from a side edge of said one wing for slidably guiding said first cam projecting portion, and a second wing of said pair of wings having a second cam groove formed in an inner surface thereof for slidably guiding said second cam projection portion;

wherein said first and second housings are fitted together through a camming action of first and second cam projection portions being respectively engaged with said first and second cam grooves upon movement of said slide member; and wherein after said first and second housings are fitted together, said pair of wings are received in said hood.

2. A low insertion force connector according to claim 1, in which said first and second cam projection portions are disposed on a common straight line, and when said pair of wings are viewed in such a manner as to be superimposed on each other, a rear end of said first cam groove overlaps a front end of said second cam groove, and when one of said first and second cam projection portions is slidingly moved, the other cam projection is retracted.

3. A low insertion force connector according to claim 1, wherein said first and second housings have a plurality of terminal accommodating chambers.

4. A low insertion force connector, comprising:

a first housing including a housing body and a first cam projection portion and a second cam projection portion mounted respectively on opposed walls of said housing;

a second housing having a hood for receiving said first housing;

a slide member insertable into said hood, said slide member including a base portion and a pair of wings extending substantially perpendicularly respectively from opposite ends of said base portion in the same direction, a first wing of said pair of wings having a first cam groove formed in an inner surface thereof and extending from a side edge of said one wing for slidably guiding said first cam projecting portion, and a second wing of said pair of wings having a second cam groove formed in an inner surface thereof for slidably guiding said second cam projection portion;

wherein said first and second housings are fitted together through a camming action of first and second cam projection portions being respectively engaged with said first and second cam grooves upon movement of said slide member; and wherein after said first and second housings are fitted together, said pair of wings are received in said hood, wherein said first and second cam projection portions are interconnected by a shaft.

5. A low insertion force connector according to claim 4, wherein only one of said first and second cam projection portions are fully engaged with said first and second cam grooves at a time, respectively.

6. A low insertion force connector according to claim 1, wherein after said first and second housings are fitted together, said pair of wings are completely received in said hood.

7. A low insertion force connector according to claim 1, wherein said wings are completely received in said housing body when said first cam projection portion is first received in said first cam groove.

8. A low insertion force connector, comprising:

a first housing including a housing body and a first cam projection portion and a second cam projection portion mounted respectively on opposed walls of said housing;

a second housing having a hood for receiving said first housing;

a slide member insertable into said hood, said slide member including a base portion and a pair of wings extending substantially perpendicularly respectively from opposite ends of said base portion in the same direction, a first wing of said pair of wings having a first cam groove formed in an inner surface thereof and extending from a side edge of said one wing for slidably guiding said first cam projecting portion, and a second wing of said pair of wings having a second cam groove formed in an inner surface thereof for slidably guiding said second cam projection portion;

wherein said first and second housings are fitted together through a camming action of first and second cam projection portions being respectively engaged with said first and second cam grooves upon movement of said slide member; and wherein after said first and second housings are fitted together, said pair of wings are received in said hood, wherein upon engagement of said first cam projection portion with said first cam groove and attendant movement of said slide member in a first direction, said first housing is urged into said second housing to a partially fitted condition and wherein upon engagement of said second cam projection portion with said second cam groove and attendant movement of said slide member in a second direction, said first housing is urged further into said second housing to a completely fitted condition.

9. A low insertion force connector according to claim 8, wherein said first and second directions are opposite each other.

10. A low insertion force connector according to claim 1, wherein said hood has a pair of slots in which said slide member is received.

11. A low insertion force connector according to claim 1, further comprising retaining means for engaging said slide member within said hood in a fully inserted position and a partially inserted position, respectively.

* * * * *